US011796152B1

(12) United States Patent
Cao et al.

(10) Patent No.: US 11,796,152 B1
(45) Date of Patent: Oct. 24, 2023

(54) LIGHTING DEVICE HAVING PRISM GRATING MICROSTRUCTURE

(71) Applicant: Xiamen PVTECH Co., Ltd., Fujian (CN)

(72) Inventors: Liangliang Cao, Fujian (CN); Fuxing Lu, Fujian (CN); Minghua Cai, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 18/122,143

(22) Filed: Mar. 16, 2023

(30) Foreign Application Priority Data

Nov. 24, 2022 (CN) ..... 202211484358.7

(51) Int. Cl.

| | |
|---|---|
| ***F21V 5/02*** | (2006.01) |
| ***F21V 19/00*** | (2006.01) |
| ***F21S 4/28*** | (2016.01) |
| *F21Y 103/10* | (2016.01) |

(52) U.S. Cl.
CPC ..... *F21V 5/02* (2013.01); *F21S 4/28* (2016.01); *F21V 19/004* (2013.01); *F21Y 2103/10* (2016.08)

(58) Field of Classification Search
CPC ..... F21V 5/02; F21V 19/004; F21S 4/28
See application file for complete search history.

(56) References Cited

U.S. PATENT DOCUMENTS

| | | | | |
|---|---|---|---|---|
| 7,559,672 | B1 * | 7/2009 | Parkyn | A47F 3/04 362/127 |
| 7,936,126 | B2 * | 5/2011 | Uang | F21K 9/27 313/493 |
| 7,976,185 | B2 * | 7/2011 | Uang | F21K 9/69 362/240 |
| 11,002,425 | B1 * | 5/2021 | Chen | F21V 5/002 |
| 2005/0122742 | A1 * | 6/2005 | Ho | F21V 5/02 362/615 |
| 2009/0290334 | A1 * | 11/2009 | Ivey | F21V 29/70 362/240 |
| 2010/0079075 | A1 * | 4/2010 | Son | F21V 17/104 362/249.02 |
| 2012/0106144 | A1 * | 5/2012 | Chang | F21K 9/27 362/218 |

* cited by examiner

*Primary Examiner* — Evan P Dzierzynski
(74) *Attorney, Agent, or Firm* — Winston Hsu

(57) ABSTRACT

A lighting device having prism grating microstructure includes a light tube body and a light source board. The light tube body includes an installation base and a light cover connected to each other to form an accommodating space. The light cover includes a first microstructure portion, a second microstructure portion and a light concentrating portion. The first microstructure portion and the second microstructure portion are disposed at the two sides of the light concentrating portion respectively, so the first microstructure portion and the second microstructure portion are connected to each other via the light concentrating portion. The light source board is disposed on the installation base and in the accommodating space. The first microstructure portion has a plurality of first prism steps orderly arranged and the second microstructure portion has a plurality of second prism steps orderly arranged. The first microstructure portion is symmetric to the second microstructure portion.

9 Claims, 10 Drawing Sheets

LIGHTING DEVICE HAVING PRISM GRATING MICROSTRUCTURE

BACKGROUND OF THE INVENTION

1. Field of the Invention

The present invention relates to a lighting device, in particular to a lighting device having prism grating microstructure.

2. Description of the Prior Art

Currently, light-emitting diode (LED) light tubes have been widely used in various industrial and commercial buildings. Besides, the performances of LED light tubes are also gradually improved. In some places, it is necessary to increase the luminance of a target area. However, currently available LED light tubes can only illuminate a large area, and cannot concentrate the lights thereon on a single target area. If a LED tube is provided with a transparent mask, obvious speckles may be incurred. Therefore, the only way to solve the above problem is to increase the power inputted into the LED light tube so as to increase the light intensity thereof, which will result in a lot of power consumption.

SUMMARY OF THE INVENTION

One embodiment of the present invention provides a lighting device having prism grating microstructure, which includes a light tube body and a light source board. The light tube body includes an installation base and a light cover connected to each other to form an accommodating space. The light cover includes a first microstructure portion, a second microstructure portion and a light concentrating portion. The first microstructure portion and the second microstructure portion are disposed at the two sides of the light concentrating portion respectively, such that the first microstructure portion and the second microstructure portion are connected to each other via the light concentrating portion. The light source board is disposed on the installation base and in the accommodating space. The first microstructure portion has a plurality of first prism steps orderly arranged and the second microstructure portion has a plurality of second prism steps orderly arranged. The first microstructure portion is symmetric to the second microstructure portion.

In one embodiment, the widths of the first prism steps are equal to each other and the widths of the second prism steps are equal to each other.

In one embodiment, each of the first prism steps has a first upper plane and a first lower plane connected to each other. The first upper plane faces in the direction toward the light source board and the first lower plane faces in the direction away from the light source board.

In one embodiment, the included angels between the first upper planes of the first prism steps and a horizontal reference plane gradually decrease in the direction away from the light source board. The horizontal reference plane is parallel to the light source board.

In one embodiment, the lengths of the first upper planes of the first prism steps gradually increase in the direction away from the light source board.

In one embodiment, each of the second prism steps has a second upper plane and a second lower plane connected to each other. The second upper plane faces in the direction toward the light source board and the second lower plane faces in the direction away from the light source board.

In one embodiment, the included angels between the second upper planes of the second prism steps and the horizontal reference plane gradually decrease in the direction away from the light source board. The horizontal reference plane is parallel to the light source board.

In one embodiment, the lengths of the second upper planes of the second prism steps gradually increase in the direction away from the light source board.

In one embodiment, the installation base has an installation groove and the light source board is disposed in the installation groove.

In one embodiment, the thickness of the light concentrating portion gradually decreases in the direction away from a vertical reference plane. The vertical reference plane passes through the central axis of the light source board and the central axis of the light concentrating portion.

The lighting device having prism grating microstructure in accordance with the embodiments of the present invention may have the following advantages:

(1) In one embodiment of the present invention, the light cover of the lighting device includes a first microstructure portion, a second microstructure portion and a light concentrating portion. The first microstructure portion and the second microstructure portion are disposed at two sides of the light concentrating portion respectively, and connected to each other via the light concentrating portion. The first microstructure portion has a plurality of first prism steps orderly arranged and the included angels between the first upper planes of the first prism steps and a horizontal reference plane gradually decrease in the direction away from the light source board. The second microstructure portion is symmetric to the first microstructure portion and has the same structure. The integrated structure of the prism grating microstructures of the microstructure portions and the light concentrating portion can effectively concentrate the lights of the lighting device without increasing the input power of the lighting device, such that the light emitted by the lighting structure can be concentrated so as to illuminate a single target area. Accordingly, the power consumption of the lighting device can be effectively reduced in order to achieve energy saving and carbon reduction.

(2) In one embodiment of the present invention, the thickness of the light concentrating portion of the light cover gradually decreases in the direction away from the vertical reference plane. The above structural design can further concentrate the light emitted by the lighting device, such that the lighting range of the lighting device can focus on a single target area. Thus, the lighting device can conform to actual requirements.

(3) In one embodiment of the present invention, the lighting device has an angle adjusting button and the user can press angle adjusting button to rotate the light tube body so as to adjust the light-emitting direction of the lighting device. Thus, the light-emitting direction of the lighting device can be adjusted according to actual requirements in order to satisfy different requirements. Accordingly, the lighting device can be more comprehensive in application and more flexible in use.

(4) In one embodiment of the present invention, the light cover of the lighting device includes the first microstructure portion, the second microstructure portion and the light concentrating portion. The integrated structure of the prism grating microstructures of the microstructure portions and the light concentrating portion not only can effectively reduce power consumption, but also can significantly decrease speckles. As a result, the lighting effect of the lighting device can be further improved.

(5) In one embodiment of the present invention, the thickness of the light concentrating portion of the light cover gradually decreases in the direction away from the vertical reference plane. The above structure can further eliminate speckles with a view to further optimizing the lighting effect of the lighting device. In this way, the lighting device can always provide great user experience.

(6) In one embodiment of the present invention, the thickness of the installation base of the light cover gradually decreases in the direction away from the vertical reference plane, which can effectively avoid that the installation base is deformed due to an external force. Therefore, the above structure can further enhance the structural strength of the installation base, so the structural stability of the lighting device can be further enhanced.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
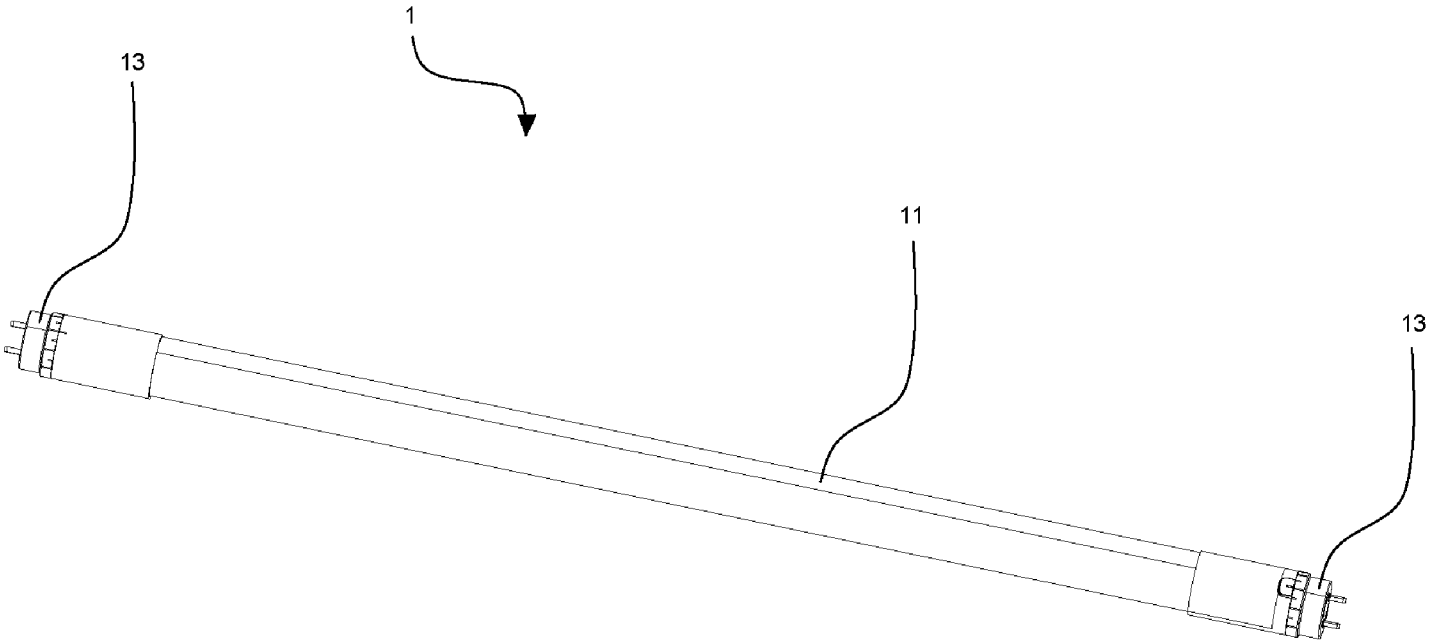
FIG. 1 is a view for illustrating a structure of a lighting device having prism grating microstructure in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Figure 2:
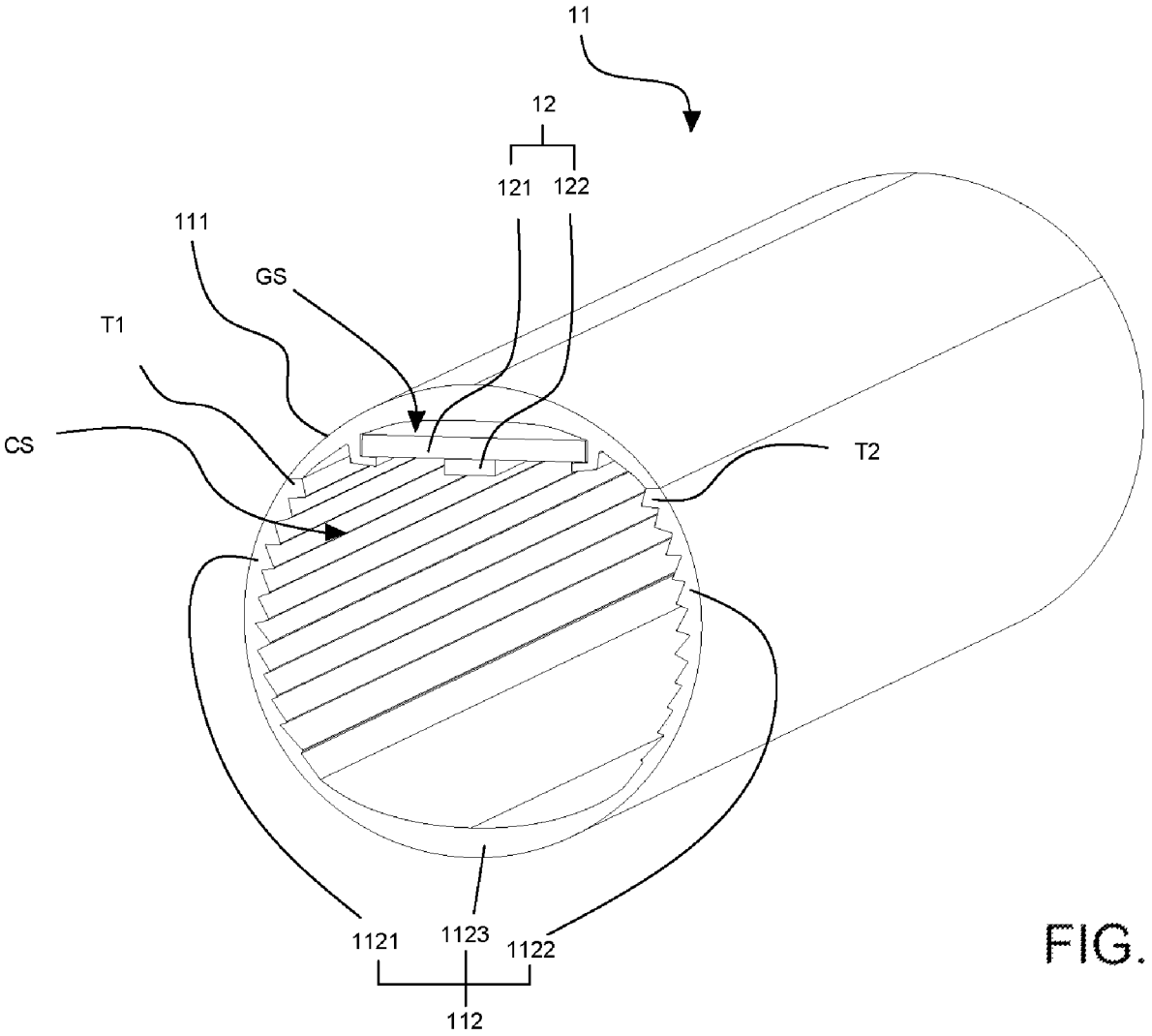
FIG. 2 is a view for illustrating an inner structure of a light tube body of the lighting device having prism grating microstructure in accordance with one embodiment of the present invention.
Figure 3:
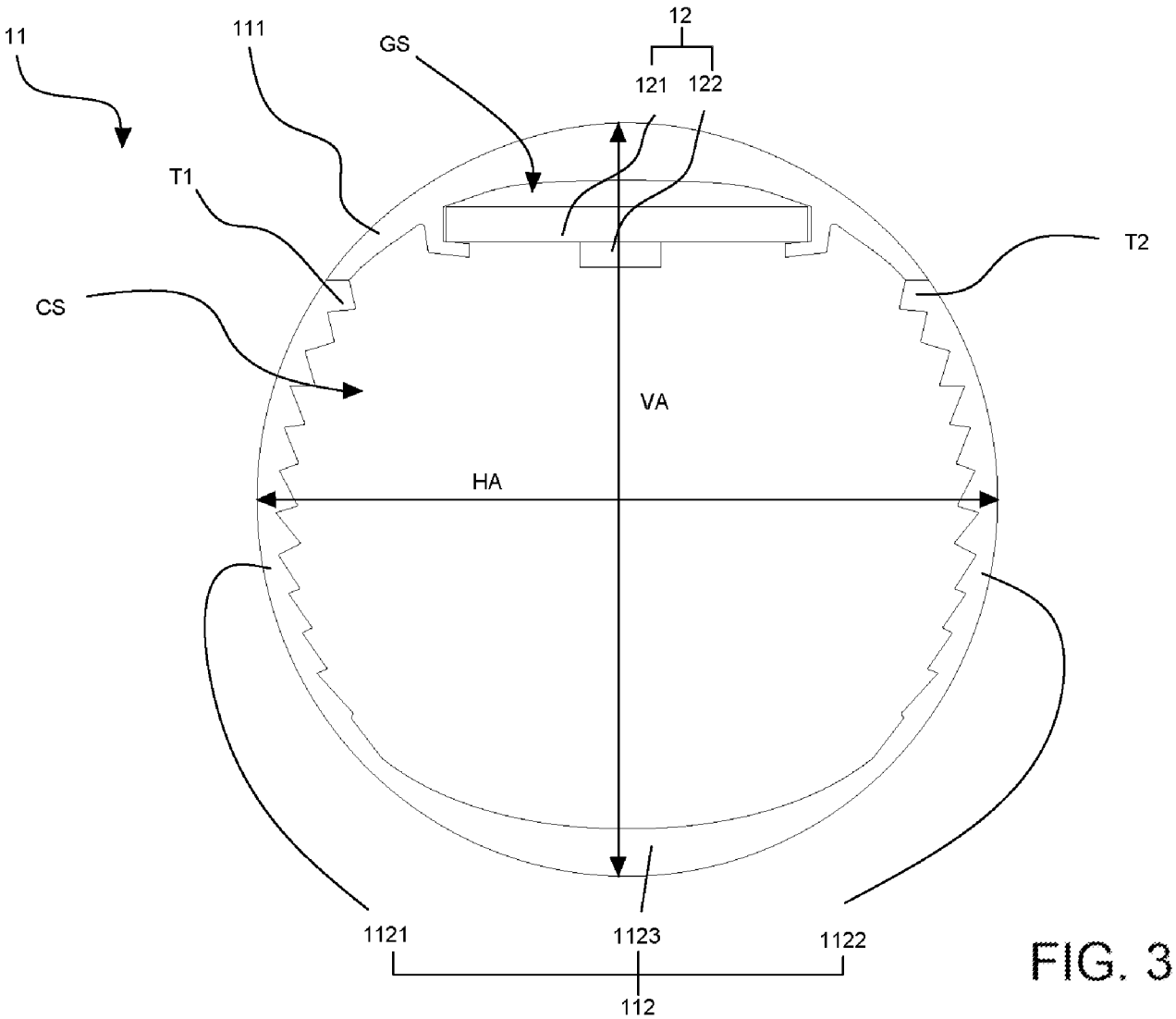
FIG. 3 is a sectional view of the light tube body of the lighting device having prism grating microstructure in accordance with one embodiment of the present invention.

Please refer to FIG. 1, FIG. 2 and FIG. 3. FIG. 1 a view for illustrating a structure of a lighting device having prism grating microstructure in accordance with one embodiment of the present invention. FIG. 2 is a view for illustrating an inner structure of a light tube body of the lighting device having prism grating microstructure in accordance with one embodiment of the present invention. FIG. 3 is a sectional view of the light tube body of the lighting device having prism grating microstructure in accordance with one embodiment of the present invention. As shown in FIG. 1, FIG. 2 and FIG. 3, the lighting device 1 includes a light tube body 11, a light source board 12 and two end caps 13. The light source board 12 is disposed in the light tube body 11, and the two end caps 13 are disposed at the two ends of the light tube body 11. The light source board 12 includes a circuit board 121 and a plurality of light-emitting units 122. A driving circuit is disposed in one of the end caps 13 and electrically connected to the light source board 12 in order to drive the light source board 12. In one embodiment, the light-emitting units 122 may be light-emitting diodes (LEDs) or other currently available light sources.

The light tube body 11 includes an installation base 111 and a light cover 112. The light cover 112 is connected to the installation base 111 in order to form an accommodating space CS. The installation base 11 has an installation groove GS and the light source board 12 is disposed in the installation groove GS and inside the accommodating space CS. In this embodiment, the cross section of the light tube body 11 is elliptical; the length of the vertical axis VA of the light tube body 11 is greater than that of the horizontal axis HA of the light tube body 11. The ratio of the horizontal axis HA to the vertical axis VA is 0.97. In another embodiment, the cross section of the light tube body 11 may be circular. The shape of the light tube body 11 can be changed according to actual requirements.

The light cover 112 includes a first microstructure portion 1121, a second microstructure portion 1122 and a light concentrating portion 1123. The first microstructure portion 1121 and the second microstructure portion 1122 are disposed at the two sides of the light concentrating portion 1123, such that the first microstructure portion 1121 is symmetric to the second microstructure portion 1122. The first microstructure portion 1121 has a plurality of first prism steps T1 orderly arranged and the second microstructure portion 1122 has a plurality of second prism steps T2 orderly arranged. In one embodiment, the light cover 112 may be made of a transparent material (i.e., the transmittance of the material is greater than 97%).

Most of the lights emitted by the light source board 12 pass through the light concentrating portion 1123 and then enter the external space, and the other of the lights emitted by the light source board 12 enter the external space after being reflected by the first microstructure portion 1121 and the second microstructure portion 1122. The first microstructure portion 1121 has the first prism steps T1 and the second microstructure portion 1122 has the second prism steps T2. Therefore, via the first microstructure portion 1121 and the second microstructure portion 1122, the lights emitted by the light source board 12 can be deflected toward the direction of the light concentrating portion 1123, such that the lights emitted by the light source board 12 can be effectively concentrated. Therefore, the lighting range of the lighting device 1 can focus on a single target area. In this embodiment, 80% of the lights emitted by the light source board 12 can enter the external space via the light concentrating portion 1123 and 20% of the lights emitted by the light source board 12 can enter the external space via the first microstructure portion 1121 and the second microstructure portion 1122. In another embodiment, the above ratio can be adjusted according to actual requirements. In addition, the size of the light concentrating portion 1223 can be changed according to the lighting-emitting characteristics of the light source board 12.

The embodiment just exemplifies the present invention and is not intended to limit the scope of the present invention; any equivalent modification and variation according to the spirit of the present invention is to be also included within the scope of the following claims and their equivalents.

Figure 4:
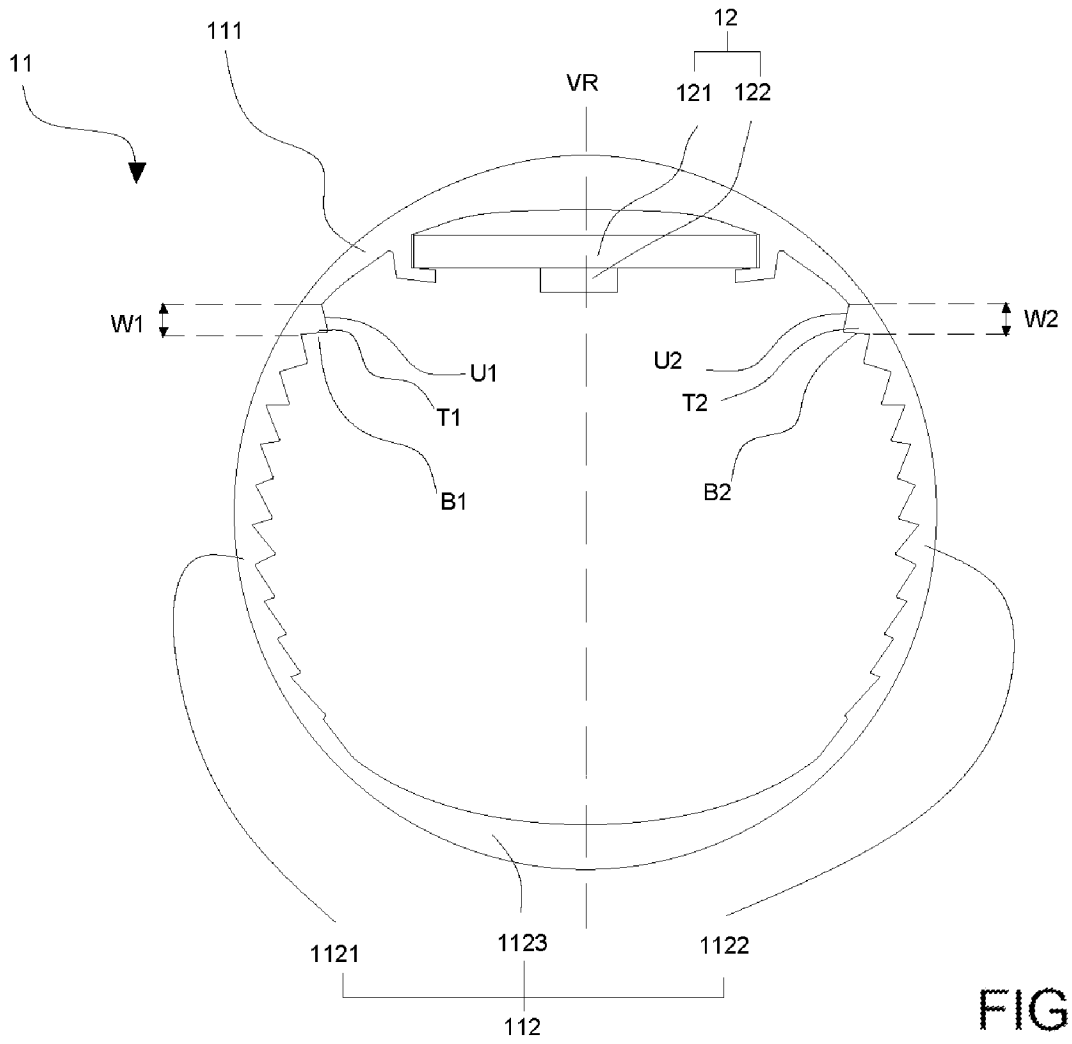
FIG. 4 is a view for illustrating a structure of the light tube body of the lighting device having prism grating microstructure in accordance with one embodiment of the present invention.

Please refer to FIG. 4, which is a view for illustrating a structure of the light tube body of the lighting device having prism grating microstructure in accordance with one embodiment of the present invention. As shown in FIG. 4, the widths W1 of the first prism steps T1 are equal to each other and the widths W2 of the second prism steps T2 are also equal to each other. The widths W1 of the first prism steps T1 may be equal to the widths W2 of the second prism steps T2.

Each of the first prism steps T1 has a first upper plane U1 and a first lower plane B1 connected to each other. The first upper plane U1 faces in the direction toward the light source board 12 and the first lower plane B1 faces in the direction away from the light source board 12.

Each of the second prism steps T2 has a second upper plane U2 and a second lower plane B2 connected to each other. The second upper plane U2 faces in the direction toward the light source board 12 and the second lower plane B2 faces in the direction away from the light source board 12.

Moreover, the thickness of the light concentrating portion 1123 gradually decreases in the direction away from a vertical reference plane VR. The vertical reference plane VR passes through the central axis of the light source board 12 (the vertical reference plane VR passes through the central point of each of the light-emitting units 122) and the central axis of the light concentrating portion 1123.

Further, the thickness of the installation base 111 also gradually decreases in the direction away from the vertical reference plane VR, which can effectively avoid that the installation base 111 is deformed due to an external force. The above structure can greatly enhance the structural strength of the installation base 111 in order to increase the structural stability of the lighting device 1.

The embodiment just exemplifies the present invention and is not intended to limit the scope of the present invention; any equivalent modification and variation according to the spirit of the present invention is to be also included within the scope of the following claims and their equivalents.

Figure 5:
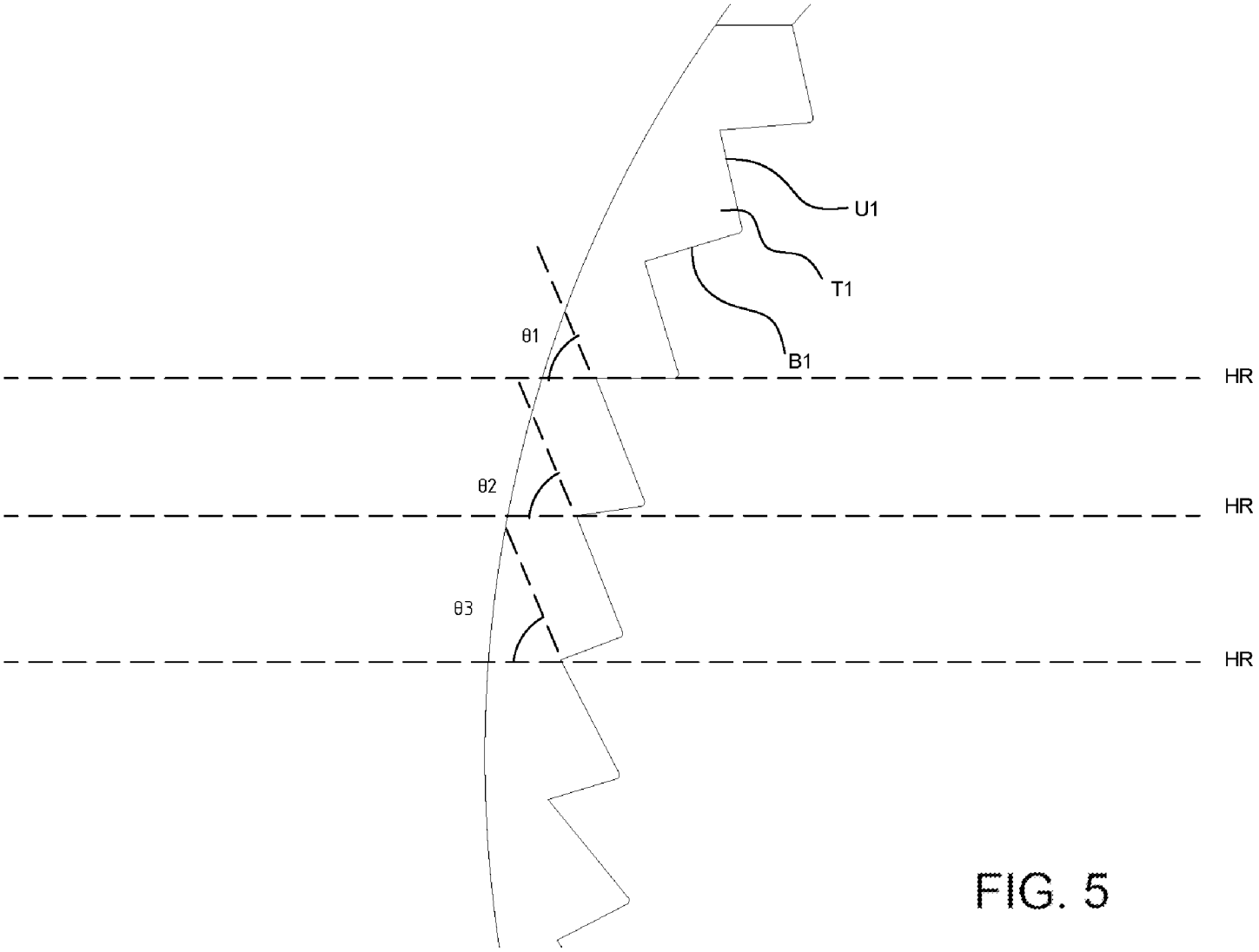
FIG. 5 is a partially enlarged view of the structure of the light tube body of the lighting device having prism grating microstructure in accordance with one embodiment of the present invention.

Please refer to FIG. 5, which is a partially enlarged view of the structure of the light tube body of the lighting device having prism grating microstructure in accordance with one embodiment of the present invention. As shown in FIG. 5, the included angels between the first upper planes U1 of the first prism steps T1 and a horizontal reference plane HR gradually decrease in the direction away from the light source board 12 ($\theta 1>\theta 2>\theta 3$). The horizontal reference plane HR is parallel to the light source board 12. On the contrary, the lengths of the first upper planes U1 of the first prism steps T1 gradually increase in the direction away from the light source board 12.

Similarly, the included angels between the second upper planes U2 of the second prism steps T2 and the horizontal reference plane HR gradually decrease in the direction away from the light source board 12. The horizontal reference plane HR is parallel to the light source board 12. The lengths of the second upper planes U2 of the second prism steps T2 gradually increase in the direction away from the light source board 12.

The embodiment just exemplifies the present invention and is not intended to limit the scope of the present invention; any equivalent modification and variation according to the spirit of the present invention is to be also included within the scope of the following claims and their equivalents.

Figure 6:
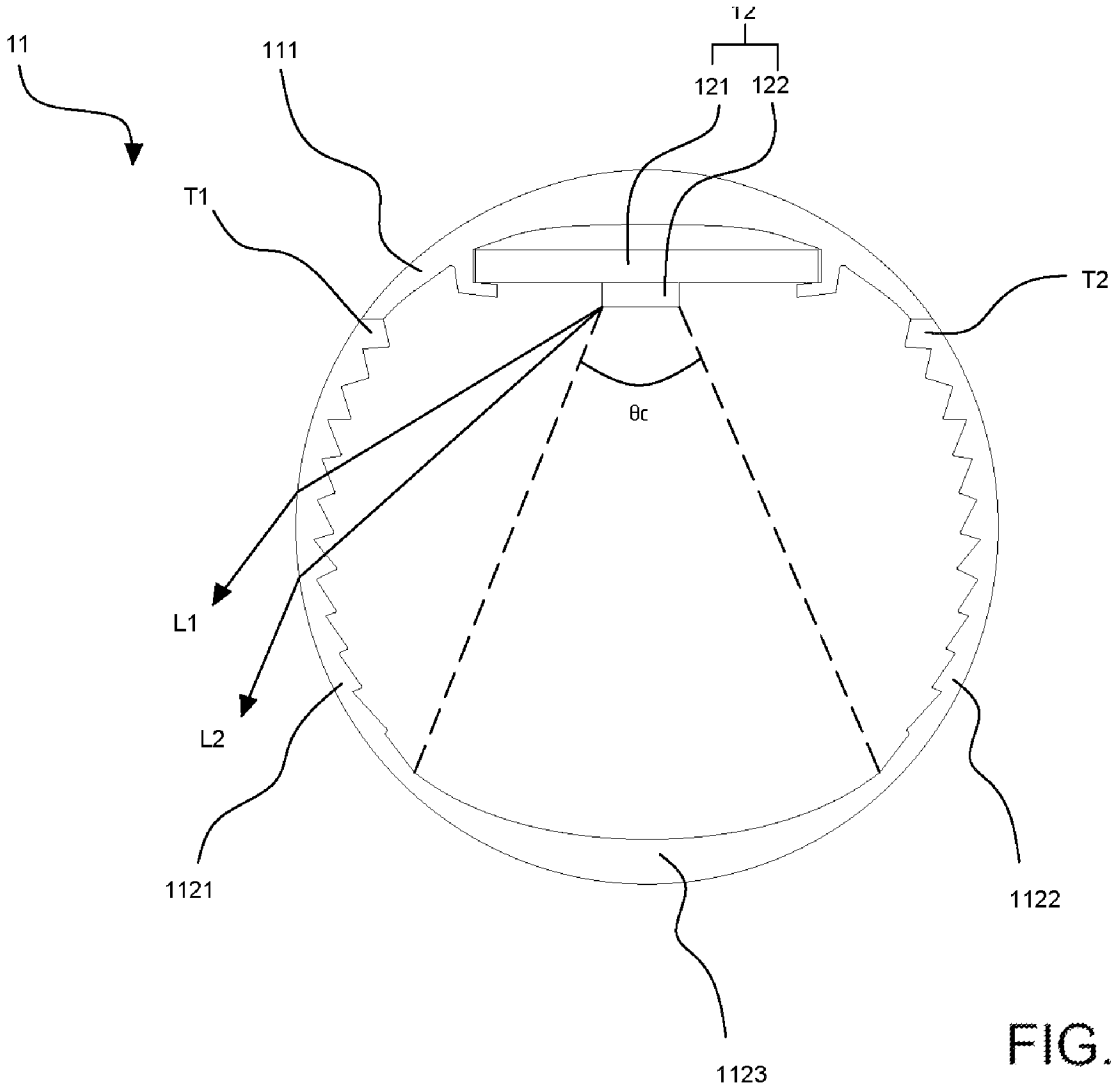
FIG. 6 is a view for illustrating an operational status of the light tube body of the lighting device having prism grating microstructure in accordance with one embodiment of the present invention.

Please refer to FIG. 6, which is a view for illustrating an operational status of the light tube body of the lighting device having prism grating microstructure in accordance with one embodiment of the present invention. As shown in FIG. 6, in this embodiment, most (about 80%) of the lights emitted by the light source board 12 are concentrated within the beam angle $\theta c$ (the beam angle $\theta c$ in this embodiment is 45°, which can be adjusted according to actual requirements), which enter the external space after being slightly deflected by the light concentrating portion 1123. The other of the lights emitted by the light source board 12 enter the external space via the first microstructure portion 1121 and the second microstructure portion 1122. The deflection angles of the lights gradually decrease in the direction toward the light concentrating portion 1123. For instance, the deflection angle of the light L1 is less than that of the light L2.

Via the above structure, the lighting device 1 can effectively concentrate the lights emitted thereby without increasing the input power thereof, such that the lighting range of the lighting device 1 can be focus on the target area. Accordingly, the power consumption of the lighting device 1 can be effectively reduced.

Moreover, the above structure can stretch the speckles generated by the lighting device 1 toward the extending direction of the light tube body 11 (i.e., the direction parallel to the central axis of the light tube body 11) so as to effectively eliminate the speckles. Thus, the lighting effect of the lighting device 1 can be further enhanced.

Furthermore, as described above, the thickness of the light concentrating portion 1123 gradually decreases in the direction away from the vertical reference plane VR. The above structure can also eliminate the speckles so as to further optimize the lighting effect of the lighting device 1. Thus, the lighting device 1 can always provide great user experience.

The embodiment just exemplifies the present invention and is not intended to limit the scope of the present invention; any equivalent modification and variation according to the spirit of the present invention is to be also included within the scope of the following claims and their equivalents.

Figure 7:
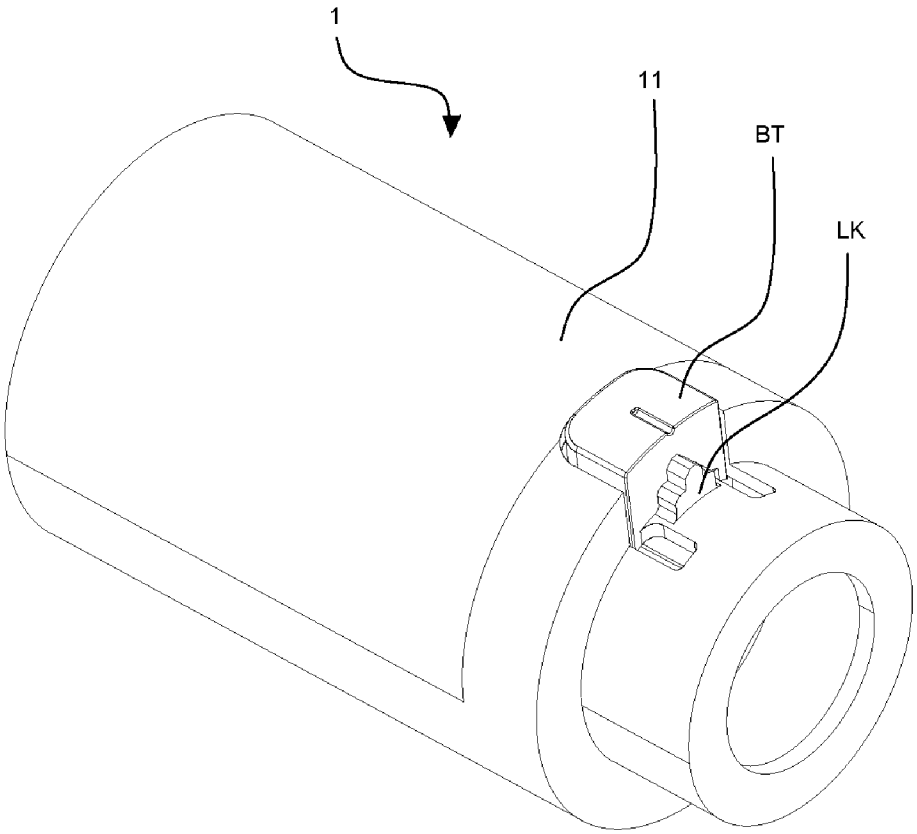
FIG. 7 is a first enlarged view of the lighting device having prism grating microstructure in accordance with one embodiment of the present invention.
Figure 8:
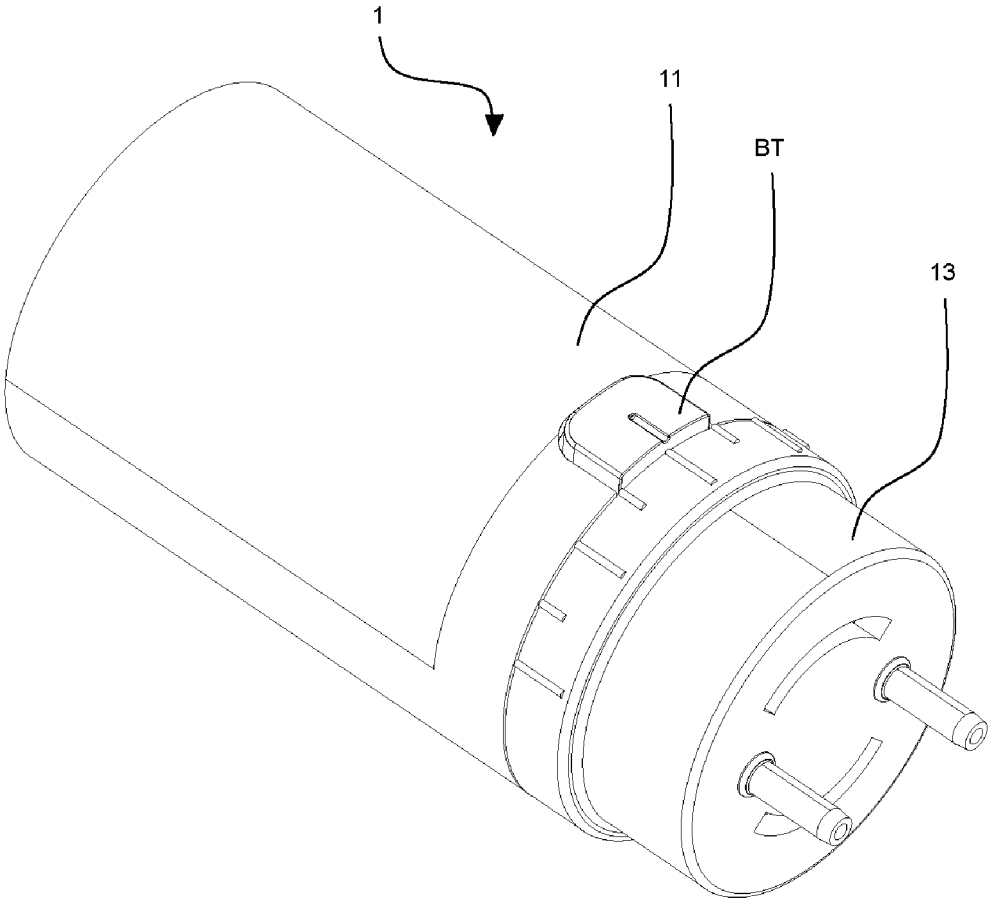
FIG. 8 is a second enlarged view of the lighting device having prism grating microstructure in accordance with one embodiment of the present invention.

Please refer to FIG. 7 and FIG. 8. FIG. 7 is a first enlarged view of the lighting device having prism grating microstructure in accordance with one embodiment of the present invention. FIG. 8 is a second enlarged view of the lighting device having prism grating microstructure in accordance with one embodiment of the present invention. As shown in FIG. 7 and FIG. 8, the light tube body 11 of the lighting device 1 has an angle adjusting button BT and a self-locking structure LK. The user can switch the self-locking structure LK from on locking state to unlocking state by pressing the angle adjusting button BT. When the self-locking structure LK is at unlocking state, the user can rotate the light tube body 11 to adjust the light-emitting direction of the lighting device 1. After the user finishes the adjustment of the light-emitting angle of the lighting device 1, the user can release the angle adjusting button BT to switch the self-locking structure LK from unlocking state to locking state. Therefore, the light-emitting direction of the lighting device 1 can be adjusted according to actual requirements so as to satisfy the requirements of different applications.

As previously stated, the lighting device 1 has the angle adjusting button BT and the user can rotate the light tube body 11 by pressing the angle adjusting button BT to adjust the light-emitting direction of the lighting device 1 in order to meet the requirements of different applications. Therefore, the lighting device 1 can be more comprehensive in application and more flexible in use.

The embodiment just exemplifies the present invention and is not intended to limit the scope of the present invention; any equivalent modification and variation according to the spirit of the present invention is to be also included within the scope of the following claims and their equivalents.

It is worthy to point out that currently available LED light tubes can only illuminate a large area, and cannot concentrate the lights on a single target area. If a LED tube is provided with a transparent mask, obvious speckles may be incurred. Therefore, the only way to achieve the above goal is to increase the power inputted into the LED light tube so as to increase the light intensity thereof, which will result in a lot of power consumption. On the contrary, according to one embodiment of the present invention, the light cover of the lighting device includes a first microstructure portion, a second microstructure portion and a light concentrating portion. The first microstructure portion and the second microstructure portion are disposed at two sides of the light concentrating portion respectively, and connected to each other via the light concentrating portion. The first microstructure portion has a plurality of first prism steps orderly arranged and the included angels between the first upper planes of the first prism steps and a horizontal reference plane gradually decrease in the direction away from the light source board. The second microstructure portion is symmetric to the first microstructure portion and has the same structure. The integrated structure of the prism grating microstructures of the microstructure portions and the light concentrating portion can effectively concentrate the lights of the lighting device without increasing the input power of the lighting device, such that the light emitted by the lighting structure can be concentrated so as to illuminate a single target area. Accordingly, the power consumption of the lighting device can be effectively reduced in order to achieve energy saving and carbon reduction.

According to one embodiment of the present invention, the thickness of the light concentrating portion of the light cover gradually decreases in the direction away from the vertical reference plane. The above structural design can further concentrate the light emitted by the lighting device, such that the lighting range of the lighting device can focus on a single target area. Thus, the lighting device can conform to actual requirements.

Also, according to one embodiment of the present invention, the lighting device has an angle adjusting button and the user can press angle adjusting button to rotate the light tube body so as to adjust the light-emitting direction of the lighting device. Thus, the light-emitting direction of the lighting device can be adjusted according to actual requirements in order to meet different requirements. Accordingly, the lighting device can be more comprehensive in application and more flexible in use.

Further, according to one embodiment of the present invention, the light cover of the lighting device includes the first microstructure portion, the second microstructure portion and the light concentrating portion. The integrated structure of the prism grating microstructures of the microstructure portions and the light concentrating portion not only can effectively reduce power consumption, but also can significantly decrease speckles. As a result, the lighting effect of the lighting device can be further improved.

Moreover, according to one embodiment of the present invention, the thickness of the light concentrating portion of the light cover gradually decreases in the direction away from the vertical reference plane. The above structure can further eliminate speckles with a view to further optimizing the lighting effect of the lighting device. In this way, the lighting device 1 can always provide great user experience.

Furthermore, according to one embodiment of the present invention, the thickness of the installation base of the light cover gradually decreases in the direction away from the vertical reference plane, which can effectively avoid that the installation base is deformed due to an external force. Therefore, the above structure can further enhance the structural strength of the installation base, so the structural stability of the lighting device can be further enhanced. As set forth above, the lighting device having prism grating microstructure according to the embodiments of the present invention can definitely achieve great technical effects.

Figure 9:
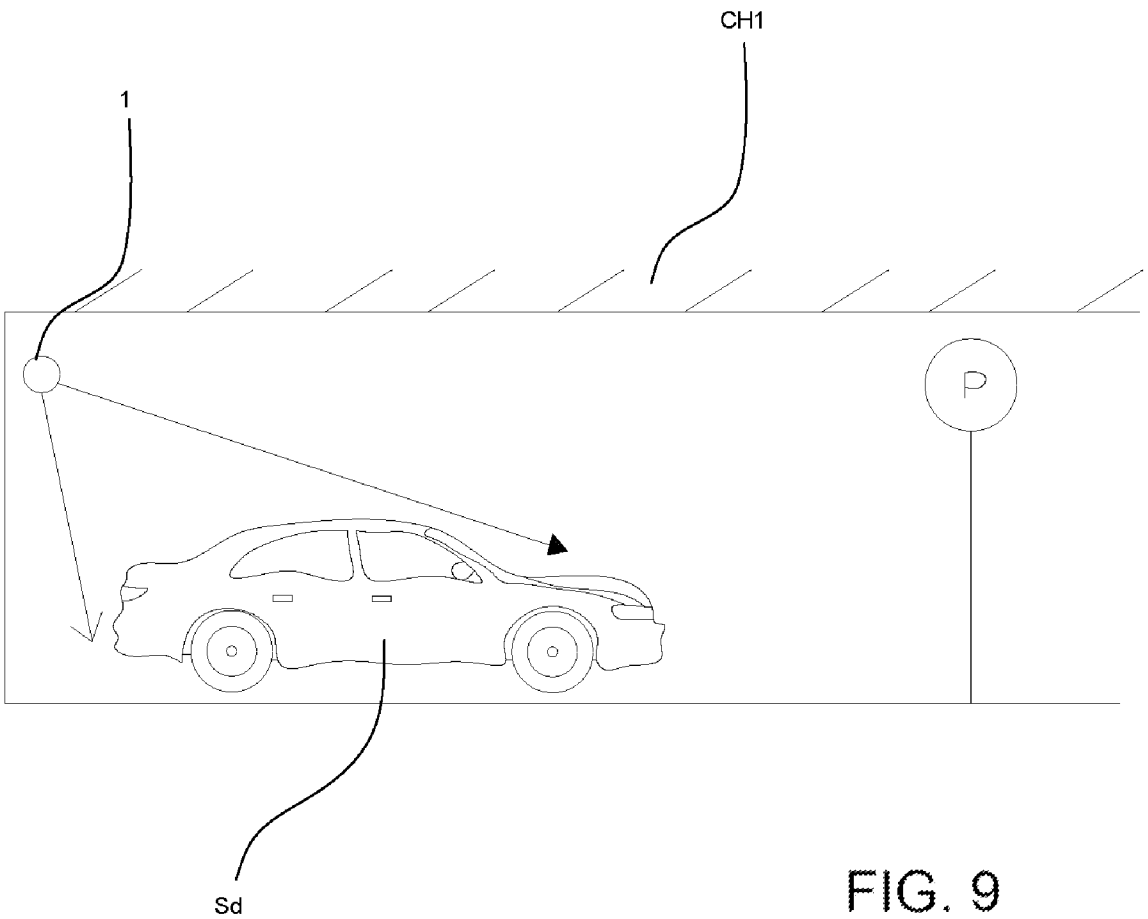
FIG. 9 is a first schematic view of a usage scenario of the lighting device having prism grating microstructure in accordance with one embodiment of the present invention.
Figure 10:
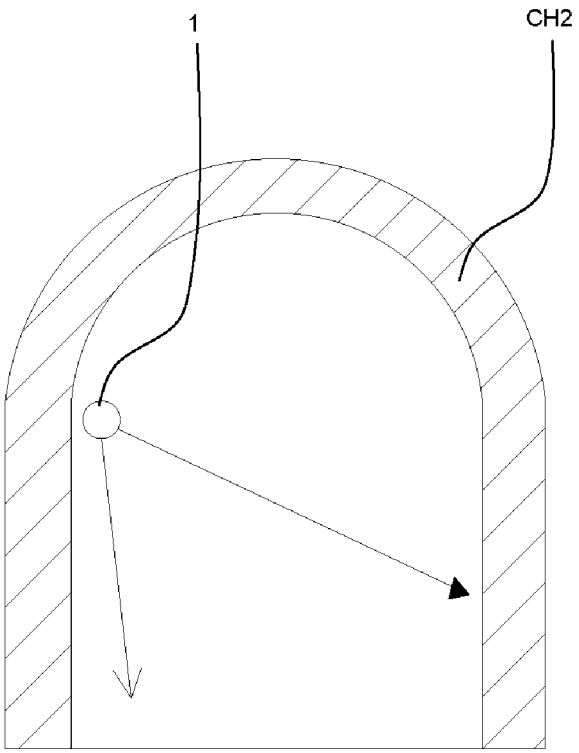
FIG. 10 is a second schematic view of another usage scenario of the lighting device having prism grating microstructure in accordance with one embodiment of the present invention.

Please refer to FIG. 9 and FIG. 10; please also refer to FIG. 1-FIG. 3. FIG. 9 is a first schematic view of a usage scenario of the lighting device having prism grating microstructure in accordance with one embodiment of the present invention. FIG. 10 is a second schematic view of another usage scenario of the lighting device having prism grating microstructure in accordance with one embodiment of the present invention. FIG. 9 illustrates the usage scenario of applying the lighting device 1 to a garage CH1. As shown in FIG. 9, the light cover 112 of the lighting device 1 includes the first microstructure portion 1211, the second microstructure portion 1122 and the light concentrating portion 1123. The integrated structure of the prism grating microstructures of the microstructure portions 1121, 1122 and the light concentrating portion 1123 can effectively concentrate the lights of the lighting device 1 without increasing the input power of the lighting device 1, such that the lights emitted by the lighting device 1 can be concentrated so as to illuminate the vehicle V. As set forth above, the above structure can further eliminate the speckles in order to further optimize the lighting effect of the lighting device 1.

FIG. 10 illustrates the usage scenario of applying the lighting device 1 to a passage CH2. As shown in FIG.10, the lights emitted by the lighting device 1 can be properly concentrated in order to illuminate the passage VH2, which can improve the lighting effect of the lighting device 1.

The embodiment just exemplifies the present invention and is not intended to limit the scope of the present invention; any equivalent modification and variation according to the spirit of the present invention is to be also included within the scope of the following claims and their equivalents.

To sum up, according to one embodiment of the present invention, the light cover of the lighting device includes a first microstructure portion, a second microstructure portion and a light concentrating portion. The first microstructure portion and the second microstructure portion are disposed at two sides of the light concentrating portion respectively, and connected to each other via the light concentrating portion. The first microstructure portion has a plurality of first prism steps orderly arranged and the included angels between the first upper planes of the first prism steps and a horizontal reference plane gradually decrease in the direction away from the light source board. The second microstructure portion is symmetric to the first microstructure portion and has the same structure. The integrated structure of the prism grating microstructures of the microstructure portions and the light concentrating portion can effectively concentrate the lights of the lighting device without increasing the input power of the lighting device, such that the light emitted by the lighting device can be concentrated so as to illuminate a single target area. Accordingly, the power consumption of the lighting device can be effectively reduced in order to achieve energy saving and carbon reduction.

According to one embodiment of the present invention, the thickness of the light concentrating portion of the light cover gradually decreases in the direction away from the vertical reference plane. The above structural design can further concentrate the light emitted by the lighting device, such that the lighting range of the lighting device can focus on a single target area. Thus, the lighting device can conform to actual requirements.

Also, according to one embodiment of the present invention, the lighting device has an angle adjusting button and the user can press angle adjusting button to rotate the light tube body so as to adjust the light-emitting direction of the lighting device. Thus, the light-emitting direction of the lighting device can be adjusted according to actual requirements in order to satisfy different requirements. Accordingly, the lighting device can be more comprehensive in application and more flexible in use.

Further, according to one embodiment of the present invention, the light cover of the lighting device includes the first microstructure portion, the second microstructure portion and the light concentrating portion. The integrated structure of the prism grating microstructures of the microstructure portions and the light concentrating portion not only can effectively reduce power consumption, but also can significantly decrease speckles. As a result, the lighting effect of the lighting device can be further improved.

Moreover, according to one embodiment of the present invention, the thickness of the light concentrating portion of the light cover gradually decreases in the direction away from the vertical reference plane. The above structure can further eliminate speckles with a view to further optimizing the lighting effect of the lighting device. In this way, the lighting device can always provide great user experience.

Furthermore, according to one embodiment of the present invention, the thickness of the installation base of the light cover gradually decreases in the direction away from the vertical reference plane, which can effectively avoid that the installation base is deformed due to an external force. Therefore, the above structure can further enhance the structural strength of the installation base, so the structural stability of the lighting device can be further enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lighting device having prism grating microstructure, comprising:

a light tube body comprising an installation base and a light cover connected to each other to form an accommodating space, wherein a light cover comprises a first microstructure portion, a second microstructure portion and a light concentrating portion, and the first microstructure portion and the second microstructure portion are disposed at two sides of the light concentrating portion respectively, whereby the first microstructure portion and the second microstructure portion are connected to each other via the light concentrating portion; and a light source board disposed on the installation base and in the accommodating space;

wherein the first microstructure portion has a plurality of first prism steps orderly arranged, and the second microstructure portion has a plurality of second prism steps orderly arranged, and the first microstructure portion is symmetric to the second microstructure portion, wherein a thickness of the light concentrating portion gradually decreases in a direction away from a vertical reference plane, and the vertical reference plane passes through a central axis of the light source board and a central axis of the light concentrating portion.

2. The lighting device having prism grating microstructure as claimed in claim 1, wherein widths of the first prism steps are equal to each other and widths of the second prism steps are equal to each other.

3. The lighting device having prism grating microstructure as claimed in claim 1, wherein each of the first prism steps has a first upper plane and a first lower plane connected to each other, and the first upper plane faces in a direction toward the light source board and the first lower plane faces in a direction away from the light source board.

4. The lighting device having prism grating microstructure as claimed in claim 3, wherein included angles between the first upper planes of the first prism steps and a horizontal reference plane gradually decrease in the direction away from the light source board, and the horizontal reference plane is parallel to the light source board.

5. The lighting device having prism grating microstructure as claimed in claim 3, wherein lengths of the first upper planes of the first prism steps gradually increase in the direction away from the light source board.

6. The lighting device having prism grating microstructure as claimed in claim 1, wherein each of the second prism steps has a second upper plane and a second lower plane connected to each other, and the second upper plane faces in a direction toward the light source board and the second lower plane faces in a direction away from the light source board.

7. The lighting device having prism grating microstructure as claimed in claim 6, wherein included angles between the second upper planes of the second prism steps and a horizontal reference plane gradually decrease in the direction away from the light source board, and the horizontal reference plane is parallel to the light source board.

8. The lighting device having prism grating microstructure as claimed in claim 6, wherein lengths of the second upper planes of the second prism steps gradually increase in the direction away from the light source board.

9. The lighting device having prism grating microstructure as claimed in claim 1, wherein the installation base has an installation groove and the light source board is disposed in the installation groove.

* * * * *